US006848449B2

(12) United States Patent
Kitao et al.

(10) Patent No.: US 6,848,449 B2
(45) Date of Patent: Feb. 1, 2005

(54) LOW FIRE-SPREADING SMOKING ARTICLE AND METHOD OF MANUFACTURING THE SAME

(75) Inventors: Satoshi Kitao, Yokohama (JP); Keigo Miura, Yokohama (JP); Takaaki Matsufuji, Yokohama (JP); Takeo Tsutsumi, Yokohama (JP); Fumio Sashide, Tokyo (JP); Sadayoshi Matsuura, Tokyo (JP)

(73) Assignee: Japan Tobacco Inc., Toyko (JP)

( * ) Notice: Subject to any disclaimer, the term of this patent is extended or adjusted under 35 U.S.C. 154(b) by 0 days.

(21) Appl. No.: 10/375,145

(22) Filed: Feb. 28, 2003

(65) Prior Publication Data

US 2003/0145869 A1 Aug. 7, 2003

Related U.S. Application Data

(63) Continuation of application No. PCT/JP01/07369, filed on Aug. 28, 2001.

(30) Foreign Application Priority Data

Aug. 29, 2000 (JP) ..... 2000-259287
Sep. 8, 2000 (JP) ..... 2000-273800

(51) Int. Cl.[7] ..... A24C 5/28
(52) U.S. Cl. ..... 131/65; 131/284; 131/58
(58) Field of Search ..... 131/65, 284, 58, 131/365, 349; 162/139

(56) References Cited

U.S. PATENT DOCUMENTS

| | | | | |
|---|---|---|---|---|
| 4,044,778 A | | 8/1977 | Cohn | |
| 5,379,788 A | * | 1/1995 | Bowen et al. | 131/331 |
| 5,450,863 A | * | 9/1995 | Collins et al. | 131/365 |
| 5,474,095 A | | 12/1995 | Allen et al. | |
| 5,878,754 A | | 3/1999 | Peterson et al. | |

FOREIGN PATENT DOCUMENTS

| | | |
|---|---|---|
| EP | 0 532 193 A1 | 3/1993 |
| EP | 0 864 259 A2 | 9/1998 |
| JP | 63-116684 A | 5/1988 |
| JP | 1-117773 A | 5/1989 |
| JP | 4-293478 A | 10/1992 |

* cited by examiner

*Primary Examiner*—Dionne A. Walls
(74) *Attorney, Agent, or Firm*—Birch, Stewart, Kolasch & Birch, LLP

(57) ABSTRACT

A smoking article is manufactured through supplying a tobacco filler material onto a tobacco wrapping paper sheet that is transferred, wrapping the tobacco filler material supplied onto the tobacco wrapping paper sheet with the tobacco wrapping paper sheet so as to prepare a rod body, and cutting the rod body into a plurality of tobacco rods each having a prescribed length. The tobacco filler material contains at least 20% by weight of expanded tobacco material. The tobacco wrapping paper sheet is coated with the burn adjusting agent during transfer of the tobacco wrapping paper sheet.

6 Claims, 11 Drawing Sheets

LOW FIRE-SPREADING SMOKING ARTICLE AND METHOD OF MANUFACTURING THE SAME

CROSS-REFERENCE TO RELATED APPLICATIONS

This is a Continuation Application of PCT Application No. PCT/JP01/07369, filed Aug. 28, 2001, which was not published under PCT Article 21(2) in English.

This application is based upon and claims the benefit of priority from the prior Japanese Patent Applications No. 2000-259287, filed Aug. 29, 2000; and No. 2000-273800, filed Sep. 8, 2000, the entire contents of both of which are incorporated herein by reference.

BACKGROUND OF THE INVENTION

1. Field of the Invention

The present invention relates to a low fire-spreading smoking article, the burning of which is continued under the ordinary smoking state, but, where the smoking article is put on a burnable material, which prevents the fire from spreading onto the burnable material, and a method of manufacturing the same.

2. Description of the Related Art

In recent years, various requirements are raised against a smoking article such as a cigarette. One of these requirements is to suppress the generation of a sidestream smoke. Recently, the smoking article, which continues its combustion under the ordinary smoking state, is required to be extinguished, when the smoking article is put on a burnable material, so as to prevent the burnable material from catching fire.

Jpn. Pat. Appln. KOKAI Publication No. 11-151082 discloses a low fire-spreading cigarette, in which a plurality of annular processed regions (burn control regions) are formed apart from each other in the longitudinal direction of a cigarette rod by coating a wrapping paper sheet for wrapping the cigarette rod in an annular shape with a suspension prepared by suspending an inorganic loading material such as chalk, clay or titanium oxide in a solvent-soluble cellulose polymer dissolved in a nonaqueous solvent.

However, the conventional low fire-spreading cigarette, which is disclosed in the prior art quoted above, is manufactured by introducing a wrapping paper sheet having the burn control regions formed in advance into a cigarette making machine, wrapping the tobacco filler material with the wrapping paper sheet so as to prepare a long rod body, and cutting the long rod body into the individual cigarettes. Therefore, it was difficult to allow the predetermined pattern of the burn control regions in the individual cigarette to coincide with the pattern of the burn control region in the individual cigarette actually manufactured by cutting the rod body. In addition, the manufacturing cost is increased, since the wrapping paper sheet is coated with the burn control region in the step of manufacturing the wrapping paper sheet.

Under the circumstances, an object of the present invention is to provide a smoking article, in which the predetermined pattern of the burn control region in the individual cigarette can be allowed to coincide easily with the pattern of the coating region of an inorganic loading material in the individual cigarette actually manufactured by cutting a rod body, and the capability of suppressing the spread of a fire can be further improved, and a method of manufacturing the particular smoking article.

BRIEF SUMMARY OF THE INVENTION

According to a first aspect of the present invention, there is provided a low fire-spreading smoking article, which is manufactured through supplying a tobacco filler material onto a tobacco wrapping paper sheet that is being transferred, wrapping the tobacco filler material supplied onto the wrapping paper sheet with the wrapping paper sheet so as to prepare a rod body, and cutting the rod body into a plurality of tobacco rods each having a prescribed length, wherein the tobacco filler material contains at least 20% by weight of expanded tobacco material and the tobacco wrapping paper sheet is coated with a burn adjusting agent during transfer of the tobacco wrapping paper sheet.

According to a second aspect of the present invention, there is provided a method of manufacturing a low fire-spreading smoking article, comprising a first step of transferring a tobacco wrapping paper sheet, a second step of coating a burn adjusting agent to the wrapping paper sheet being transferred, a third step of supplying a tobacco filler material containing at least 20% by weight of expanded tobacco material onto the wrapping paper sheet coated with the burn adjusting agent, a fourth step of wrapping the tobacco filler material supplied onto the wrapping paper sheet with the wrapping paper sheet so as to prepare a rod body, and a fifth step of cutting the rod body into a plurality of tobacco rods each having a prescribed length.

In a preferred embodiment, the tobacco wrapping paper sheet is coated with the burn adjusting agent in synchronism with the cutting of the rod body.

In the present invention, the burn adjusting agent may be coated in the form of a plurality of stripes formed apart from each other and extending in the longitudinal direction of the tobacco rod, in the form of a plurality of annuluses formed apart from each other and extending in the circumferential direction of the tobacco rod, or in the form of dots formed apart from each other.

In one embodiment, the tobacco wrapping paper sheet is not coated with the burn adjusting agent in the region covering the tip region of the tobacco rod having a length of 10 mm to 25 mm from the tip.

DETAILED DESCRIPTION OF THE INVENTION

Figure 1:
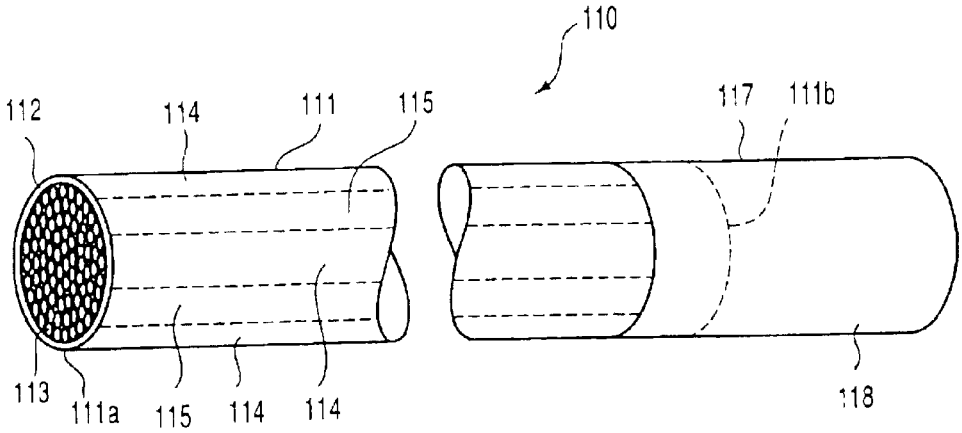
FIG. 1 is an oblique view, partly broken away, exemplifying a cigarette according to one embodiment of the present invention.

Various embodiments of the present invention will now be described in detail with reference to the accompanying drawings. Throughout the drawings, like elements are denoted by like reference numerals.

A smoking article according to the present invention can be prepared through supplying a tobacco filler material onto a tobacco wrapping paper sheet that is being transferred, preparing a rod body by wrapping the tobacco filler material supplied onto the wrapping paper sheet with the wrapping paper sheet, and cutting the rod body into a plurality of tobacco rods each having a predetermined length. The tobacco wrapping paper sheet is coated with a burn adjusting agent, described below, during transfer of the wrapping paper sheet.

FIG. 1 is an oblique view, partly broken away, showing a cigarette as a smoking article according to one embodiment of the present invention.

As shown in FIG. 1, a cigarette 110 includes a tobacco rod 111 consisting of a tobacco filler material 113 wrapped or wound in the shape of a column with a tobacco wrapping paper sheet 112. The tobacco wrapping paper sheet 112 may be an ordinary tobacco wrapping paper sheet made of, for example, a hemp pulp and to have an inherent air permeability of 10 to 100 CORESTA units. The tobacco rod 111 has generally a circumferential length of 17 mm to 26 mm and an axial length of 49 mm to 90 mm. An ordinary filter 118 may be attached to the proximal end 111*b*, i.e., downstream edge in the inhaling direction, of the tobacco rod 111 by the ordinary method by using a tip paper 117.

In the present invention, the wrapping paper sheet 112 is coated with a burn adjusting agent during the transferring step of the wrapping paper sheet, and the tobacco filler material 113 contains at least 20% by weight of expanded tobacco shreds, as described herein later. In this case, the wrapping paper sheet of the individual smoking article after the cutting step is coated with the burn adjusting agent as designed. In addition, it has been found unexpectedly that the spread of a fire from the resultant cigarette to a burnable material can be further suppressed, compared with the case where the tobacco filler material does not contain the expanded tobacco shreds. The expanded tobacco shreds used are not particularly limited. However, it is possible to use in general the expanded tobacco shreds having a bulk density of 140 to 170 mg/cm$^3$. Incidentally, non-expanded shreds have a bulk density of 200 to 300 mg/cm$^3$. In general, the tobacco filler material 113 is loaded at a density of about 150 to 300 mg/cm$^3$.

The tobacco wrapping paper sheet is coated with a burn adjusting agent during the transfer of the tobacco wrapping paper sheet. The tobacco wrapping paper sheet may be coated with the burn adjusting agent in the form of, for example, a plurality of stripes extending in the longitudinal direction of the tobacco rod. For example, 2 to 10 stripes of burn control regions 114 are formed on one surface (usually, the inner surface of the tobacco wrapping paper sheet 112 in contact with the columnar tobacco filler material 113) of the tobacco wrapping paper sheet 112. The burn control regions 114 are formed apart from each other in the circumferential direction of the tobacco rod 111 and extend continuously in the longitudinal direction of the tobacco rod 111. As a result, regions 115 consisting of the wrapping paper sheet 112 alone and having no burn control region thereon are formed between the adjacent burn control regions 114. Since the region 115 is formed of the portion of the wrapping paper sheet 112, the region 112 can burn under the ordinary smoking state like the wrapping paper sheet 112 itself. It follows that the region 115 generally performs the function of the burn region. In general, the stripe of the burn control region 114 has a thickness of 2 to 10 $\mu$m.

Figure 2:
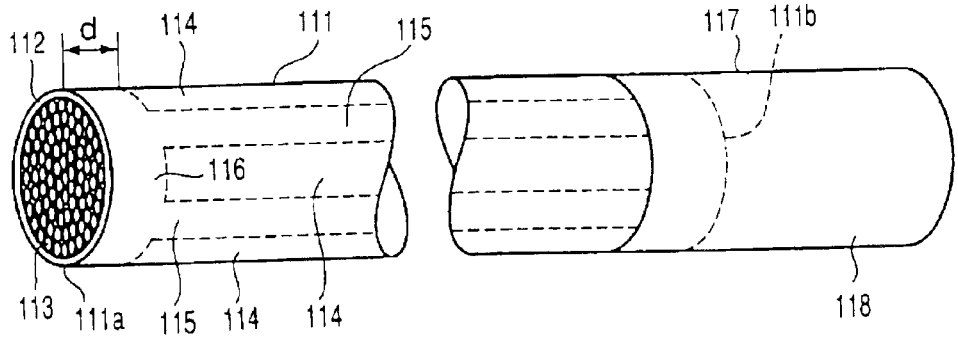
FIG. 2 is an oblique view, partly broken away, exemplifying a cigarette according to another embodiment of the present invention.

As shown in FIG. 1, each of the stripes of the burn control regions 114 may be formed in a manner to extend from the tip of the wrapping paper sheet 112 corresponding to the tip of the tobacco rod 11, i.e., from the upstream edge in the inhaling direction, to reach a region in the vicinity of the proximal end 111*b* of the tobacco rod 111. Alternatively, each stripe of the burn control region 114 may be formed in a manner to extend from a position that is a distance d of 10 mm to 25 mm away from the tip 111*a* of the tobacco rod to reach a region in the vicinity of the proximal end 111*b* of the tobacco rod 111, as shown in FIG. 2. In general, the tip portion where no burn control region is formed also constitutes a burn region 116, and may correspond to the region that burns in the first puff or second puff of a cigarette, maintaining the taste of the smoking of the ordinary cigarette in the initial smoking state. In any case, it is not particularly necessary to form the burn control region 114 on the inner surface of that region of the wrapping paper sheet 112 which is covered with the tip paper 117.

The burn control region 114 can be formed by the coating of a burn adjusting agent. The burn adjusting agent used in the present invention preferably includes, for example, proteins such as gelatin, casein, albumin, and gluten; polysaccharides performing a thickening function such as starch, xanthane gum (echo gum), locust bean gum, guar gum (guar pack), tragacanth, tara gum, tamalindo seed polysaccharides (glyroid), karaya gum, gum arabic, pulran, dextrin, cyclodextrin (oligoseven), and gutty; polysaccharides performing a gelling function such as carrageenan, curdlan, agar, gelatin, farselran, pectin, jeram gel, and kelco gum; lipids such as lecithin; natural high molecular weight derivatives such as carboxymethyl cellulose, methyl cellulose, propylene glycol alginate ester, and a processed starch such as starch phosphate; synthetic high molecular weight compounds such as poly(sodium acrylate) and various high molecular weight emulsifying agents; inorganic ammonium salts such as ammonium chloride, ammonium phosphate, ammonium hydrogen phosphate, ammonium dihydrogen phosphate, ammonium bromide and ammonium sulfate; inorganic hydroxides such as barium hydroxide, calcium hydroxide, and aluminum hydroxide; and inorganic salt flame retardants such as sodium borate, boric acid, zinc chloride, magnesium chloride, calcium chloride and sodium sulfate. These burn adjusting agents can be used singly or in the form of a mixture of at least two of these burn adjusting agents.

The striped burn control region 114 can be formed on the wrapping paper sheet 112 by transferring a solution or dispersion prepared by dissolving or dispersing a burn adjusting agent in, for example, water by using a prescribed roller. Alternatively, an aqueous solution or dispersion of the burn adjusting agent can be applied to the wrapping paper sheet 112 by using a plurality of pressurizing nozzles. It is also possible to apply a screen printing method for forming the striped burn control region 114.

If the cigarette 110 is ignited at the edge 111*a* of the cigarette rod 111 and sucked to burn the cigarette, the cigarette can burn like an ordinary cigarette in which no burn control region 114 is formed because the burn region 115 extends in general in the burning direction. As a result, the smoking can be tasted. Also, the natural combustion is essentially continued so as to prevent the cigarette from being extinguished. In other words, the burning is essentially continued under the ordinary smoking state in the cigarette of the present invention. However, where the cigarette under the ignited state is put on a burnable material or item such as a carpet, a tatami mat, a wooden article, cloths or garments, the burn control region 114 essentially extending in the combustion direction, the heat absorption performed by the burnable material, and the expanded tobacco shreds contained in the tobacco filler material collectively serve to extinguish the cigarette 110 so as to suppress the spread of a fire to the burnable material.

Under the circumstances, it is desirable for the burn control region 114 to have a width in the circumferential direction of the tobacco rod 111 of 1 mm to 6 mm. It is also desirable for the adjacent burn control regions 114 to be apart from each other by 2 mm to 20 mm. In other words, it is desirable for the ordinary burn region 115 to have a width falling within a range of 2 mm to 20 mm.

The present invention also provides a method of manufacturing a low fire-spreading smoking article, comprising a first step of transferring a tobacco wrapping paper sheet, a second step of coating a burn adjusting agent to the wrapping paper sheet that is being transferred, a third step of supplying a tobacco filler material containing at least 20% by weight of a expanded tobacco material to the wrapping paper sheet coated with the burn adjusting agent, a fourth step of preparing a rod body by wrapping the tobacco filler material supplied onto the wrapping paper sheet with said wrapping paper sheet, and a fifth step of cutting the rod body into pieces each having a prescribed length. Preferably, the wrapping paper sheet is coated with a burn adjusting agent in synchronism with the cutting of the rod body.

Figure 3:
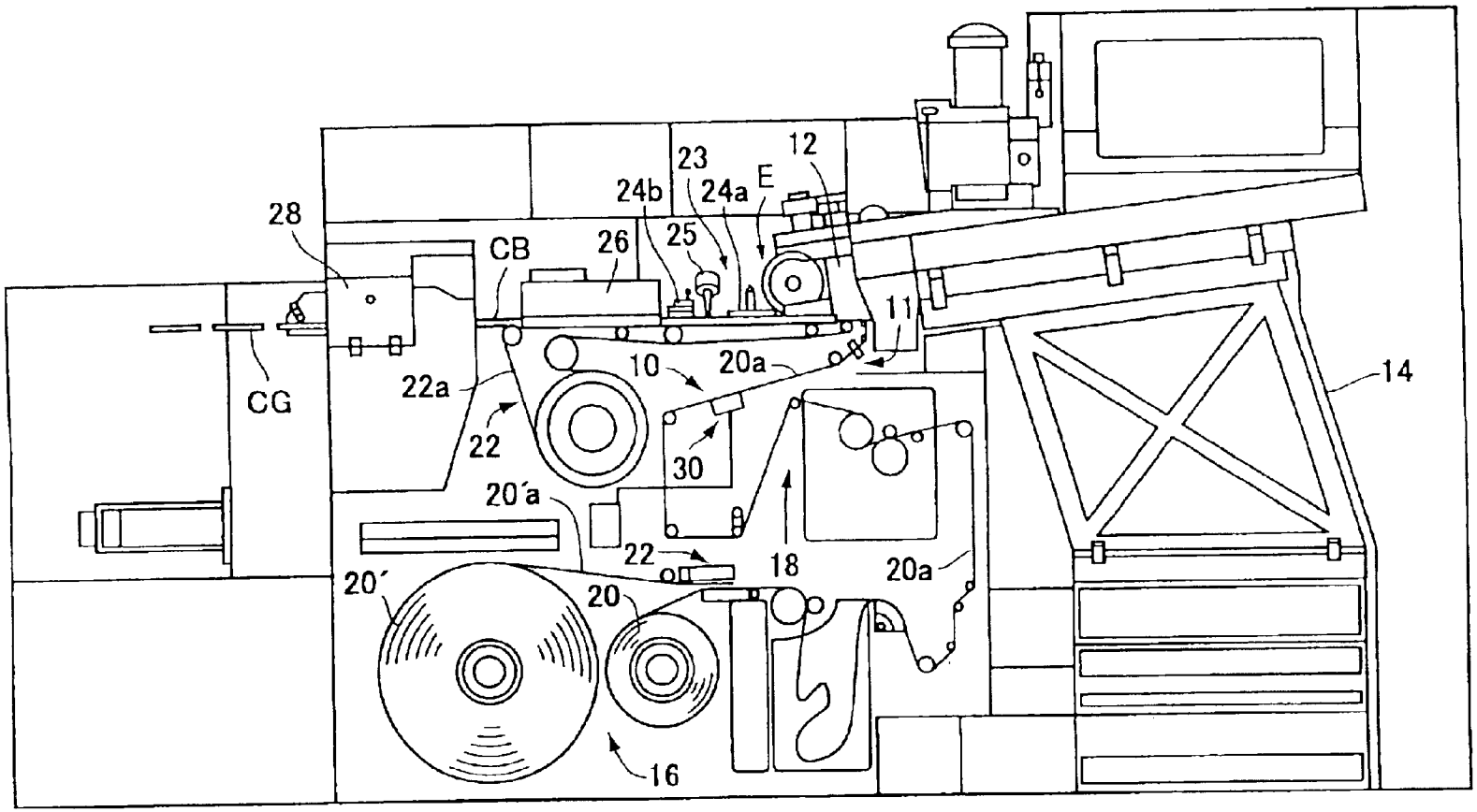
FIG. 3 schematically shows the entire construction of a cigarette making machine suitable for carrying out the method for manufacturing the cigarette, i.e., a low fire-spreading smoking article, according to one embodiment of the present invention.

FIG. 3 shows the entire construction of a cigarette making machine that is suitably used for manufacturing a low fire-spreading smoking article, i.e., a cigarette, according to one embodiment of the present invention.

The construction of the cigarette making machine shown in FIG. 3 is equal to the construction of the conventional cigarette making machine except an apparatus 10 for manufacturing a low fire-spreading cigarette wrapping paper sheet and an apparatus 11 for inspecting the low fire-spreading cigarette wrapping paper sheet.

The cigarette making machine shown in FIG. 3 comprises an air permeable transfer means 12 for transferring a tobacco filler material. An air permeable transfer belt is used as the tobacco filler material transfer means 12. A tobacco filler material supplying passageway member 14 extends from a tobacco filler material supply source (not shown) to the tobacco filler material transfer means 12. A tobacco filler material containing at least 20% by weight of a expanded tobacco material is transferred by utilizing an air stream from the tobacco filler material supply source to the tobacco filler material transfer means 12 through the tobacco filler material supply passageway member 14.

The tobacco filler material supplied from the tobacco filler material supply source is pressed against the upper region of the tobacco filler material transfer means 12 at the end of the tobacco filler material supply passageway member 14 in the form of a slender band having a prescribed width along the center line in the transfer direction (longitudinal direction) of the tobacco filler material transfer means 12.

The end of the main portion of a wrapping paper sheet transfer means 18 for transferring a cigarette wrapping paper sheet from a cigarette wrapping paper sheet supply source 16 is positioned at the end E in the transfer direction of the tobacco filler material transfer means 12. In the embodiment shown in the drawing, a roll 20 of a long web used as a material of the wrapping paper sheet before the wrapping paper sheet is cut into small pieces for wrapping the individual cigarettes is rotatably arranged in the wrapping paper sheet supply source 16, and the long web 20*a* withdrawn from the roll 20 by the main portion of the wrapping paper sheet transfer means 18 is transferred to the end portion noted above via a slackening preventing means.

In the embodiment shown in the drawing, the main portion of the wrapping paper sheet transfer means 18 includes a large number of pairs of tension rollers, pairs of guide rollers and pairs of driving rollers.

An additional roll 20' is also arranged rotatable, together with the roll 20, in the wrapping paper sheet supply source 16. An automatic joining means 22 permits the starting end of a web 20'*a* of the additional roll 20' to face the long web 20 a withdrawn from the roll 20 by the wrapping paper sheet transfer means 18. If the end of the web 20 supplied from the roll 20 is detected by the automatic joining means 22, the automatic joining means 22 permits the starting end of the web 20'*a* of the additional roll 20' to be connected to the trailing end of the web 20*a* of the roll 20. As a result, the web 20'*a* of the additional roll 20' is transferred toward the end of the main portion of the wrapping paper sheet transfer means 18 in succession to the web 20*a* of the roll 20.

The wrapping paper sheet transfer means 18 also comprises a wrapping paper supporting and transferring means 22 arranged downstream of the end of the main portion. In the embodiment shown in the drawing, a transfer belt 22*a* supported by a plurality of guide rollers and driving rollers is used as the wrapping paper sheet supporting and transferring means 22 such that the web 20*a* or 20'*a* coming from the end of the main portion is transferred by the transfer belt 22*a* arranged in the horizontal transfer portion above the transfer belt 22*a*.

A scraper (not shown) is arranged in the terminal E in the transfer direction of the tobacco filler material transfer means 12 such that the tobacco filler material is forcibly scratched off by the scraper at the terminal E onto the web 20*a* or 20'*a* on the upper horizontal transfer portion of the transfer belt 22*a*. The transfer direction of the web 20 or 20'*a* on the upper horizontal transfer portion of the transfer belt 22*a* is equal to the transfer direction of the tobacco filler material transferred by the tobacco filler material transfer means 12 such that the center line in the transfer direction of the tobacco filler material transfer means 12 corresponds in a vertical direction to the center line in the transfer direction of the upper horizontal transfer portion of the transfer belt 22*a*. It follows that the tobacco filler material forcibly scratched off from the terminal E in the transfer direction of the tobacco filler material transfer means 12 onto the web 20 or 20'*a* on the upper horizontal transfer portion of the transfer belt 22*a* is deposited to form a slender band on the web 20 or 20'*a*, said slender band extending along the center line in the transfer direction of the web 20*a* or 20'*a*.

A winding device 23 is arranged along the upper horizontal transfer portion of the transfer belt 22*a*. The web 20*a* or 20'*a* on which the tobacco filler material is deposited to form a slender stripe on the upper horizontal transfer portion of the transfer belt 22*a* is wound up by the winding device 23 in the shape of a cigarette, i.e., in the form of an oblong cylinder, in accordance with progress of the upper horizontal transfer portion of the transfer belt 22*a*.

The winding device 23 includes wind-up means 24*a*, 24*b* arranged in the transfer direction of the upper horizontal transfer portion, a paste attaching means 25, a paste drying means 26 and a cutting means 28. The wind-up means 24 a serves to pull up the both side portions of the web 20*a* or 20'*a* on which the tobacco filler material is deposited to form an oblong band on the upper horizontal transfer portion so as to form a substantially U-shaped cross section and, then, to bend further one of the side portions so as to wrap the tobacco filler material on the oblong band-like tobacco filler material. The paste attaching means 25 serves to attach a paste to the edge of one of the side portions of the web 20*a* or 20'*a* that have been pulled upward. The remaining wind-up means 24*a* serves to bend tubular one side portion of the web 20*a* or 20'*a*, to which a paste is already attached, toward the edge of the other side portion that is already bent tubular as described above so as to attach the edge of said one side portion to the edge of the other side portion with the paste. As a result, the web 20*a* or 20'*a* is formed into a rod CB of a cylindrical oblong cigarette having the tobacco filler material loaded therein.

The rod CB of the oblong cigarette is passed through the paste drying means 26 so as to dry the paste contained in the rod CB of the oblong cigarette and, then, the rod CB is cut into a plurality of pieces each having a prescribed length by the cutting means 28 so as to obtain a cigarette CG having a prescribed length. Needless to say, the wrapping paper sheet is consecutively transferred throughout the process steps described above so as to be supplied for each operation. The cutting means 28 is operated so as to cut the rod CB of the cigarette at the time when the rod CB of the cigarette is moved forward by a prescribed length.

Needless to say, the transfer direction of the long web 20*a* or 20'*a* of the wrapping paper sheet, which is transferred by the wrapping paper sheet transfer means 18, is the direction in which the long web 20*a* or 20'*a* of the wrapping paper sheet extends in the longitudinal direction under the state that the web 20*a* or 20'*a* is wound in the form of a cigarette.

The construction of the cigarette making machine shown in FIG. 3 under the state described above is equal to the construction of a conventional cigarette making machine.

The apparatus 10 for manufacturing the low fire-spreading cigarette wrapping paper sheet, which is a novel construction included in the cigarette making machine shown in FIG. 3, comprises means 30 for forming a stripe of a burn adjusting agent, said means 30 being used in combination with the main portion of the wrapping paper sheet transfer means 18.

Such being the situation, the construction of the means 30 for forming the stripe of the burn adjusting agent will now be described in detail with reference to FIG. 4, which shows in a magnified fashion the periphery of the means 30 for forming the stripe of the burn adjusting agent included in the cigarette making machine shown in FIG. 3, in addition to FIG. 3.

The means 30 for forming the stripe of the burn adjusting agent serves to form a plurality of stripes of the burn adjusting agent, which has already been described, on the surface of the side forming the inner surface when the long web 20*a* or 20'*a* of the wrapping paper sheet transferred by the main portion of the wrapping paper sheet transfer means 18 is wound in the shape of a cigarette in a manner to extend in the direction forming the longitudinal direction when the web 20*a* or 20'*a* is wound in the shape of a cigarette. In the embodiment shown in the drawing, the web 20*a* or 20'*a* wound in the shape of a cigarette extends in the direction in which the long web 20*a* or 20'*a* of the wrapping paper sheet is transferred by the wrapping paper sheet transfer means 18.

The means 30 for forming the stripe of the burn adjusting agent comprises a roller 30*a* capable of contact with one surface of the long web 20*a* or 20'*a* of the wrapping paper sheet transferred by the main portion of the wrapping paper sheet transfer means 18 and rotatable in said transfer direction and a burn adjusting agent attaching means 30*b* for supplying a burn adjusting agent onto the outer circumferential surface of the roller 30*a* so as to permit the burn adjusting agent to be attached to the outer circumferential surface of the roller 30*a*. A rotating force is transmitted from a rotary driving means, e.g., a motor (not shown), included in the cigarette making machine shown in FIG. 3 to the roller 30*a* by a mechanical rotating force transmitting means (not shown). As a result, the roller 30*a* is rotated in the rotating direction and at the peripheral speed conforming with the transfer direction and the transfer speed of the long web 20*a* or 20'*a* of the wrapping paper sheet transferred by the wrapping paper sheet transfer means 18.

The one surface of the long web 20*a* or 20'*a* of the wrapping paper sheet referred to above, forms the inner surface when the long web 20*a* or 20'*a* is wound later about the tobacco filler material so as to provide a cigarette structure.

The burn adjusting agent attaching means 30*b* comprises a burn adjusting agent tank 32, a pump 34 equipped with a control means joined to the burn adjusting agent tank 32, and a burn adjusting agent attaching member 36 in contact with the outer circumferential surface of the roller 30*a* and serving to allow the pump 34 equipped with the control means to attach the burn adjusting agent supplied from the burn adjusting agent tank 32 to the outer circumferential surface of the roller 30*a*.

It is possible for the wrapping paper sheet transfer means 18 to include a position control means 18*a* in the width direction of the wrapping paper sheet, which is arranged in the vicinity of the roller 30*a* for controlling the position in the width direction of the long web 20*a* or 20'*a* of the wrapping paper sheet relative to the outer circumferential surface of the roller 30*a*, and a wrapping paper sheet attaching-detaching means 18*b* for selectively allowing the long web 20*a* or 20'*a* of the wrapping paper sheet transferred by the wrapping paper sheet transfer means 18 to be brought into contact with or to be moved away from the outer circumferential surface of the roller 30*a*. When the cigarette making machine shown in FIG. 3 is not operated, the wrapping paper sheet attaching-detaching means 18*b* permits the web 20*a* or 20'*a* to be positioned away from the outer circumferential surface of the roller 30*a* as denoted by a two dots-and-dash line in FIG. 4. On the other hand, during operation of the machine for manufacturing a low fire-spreading cigarette shown in FIG. 3, the wrapping paper sheet attaching-detaching means 18*b* permits the web 20*a* or 20'*a* to be brought into contact with the outer circumferential surface of the roller 30*a* as denoted by a solid line in FIG. 4.

Figure 5A:
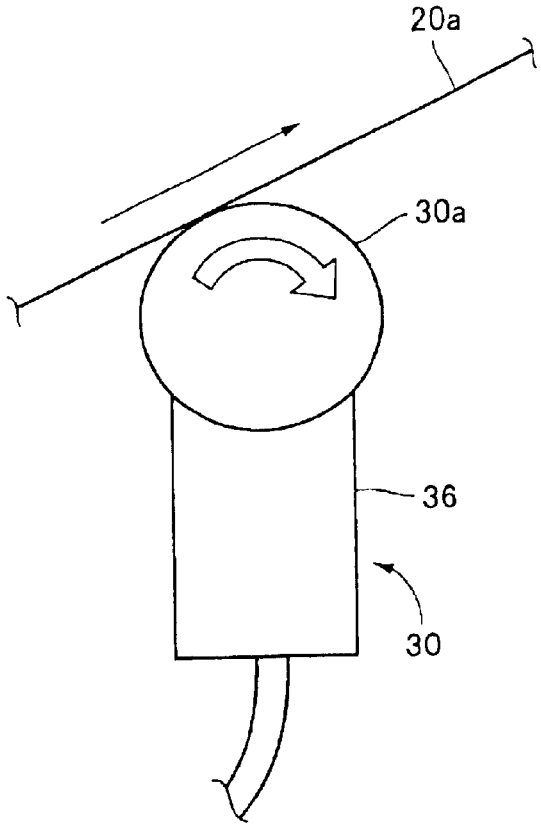
FIG. 5A is a side view showing in a magnified fashion the roller shown in FIG. 4 and used as a means for forming the stripe of the burn adjusting agent, the burn adjusting agent attaching member, and a long web of the wrapping paper sheet transferred by the wrapping paper sheet transfer means.
Figure 5B:
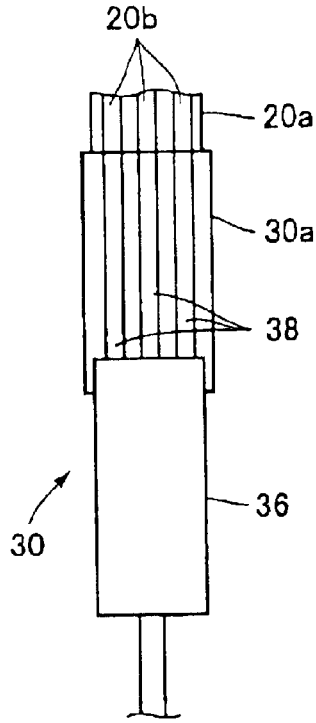
FIG. 5B is a front view showing the roller, the burn adjusting agent attaching member and the web shown in FIG. 5A.

The construction of the roller 30*a* included in the means 30 for forming the stripe of the burn adjusting agent will now be described in detail with reference to FIGS. 5A and 5B. FIG. 5A is a side view showing in a magnified fashion the roller 30*a* included in the means 30 for forming the stripe of the burn adjusting agent, the burn adjusting agent attaching member 36, and the long web 20*a* of the wrapping paper sheet transferred by the wrapping paper sheet transfer means 18. On the other hand, FIG. 5B is a front view showing the roller 30*a*, the burn adjusting agent attaching member 36 and the web 20*a* shown in FIG. 5A.

A plurality of burn adjusting agent transfer regions 38 extending in the circumferential direction are formed on the outer circumferential surface of the roller 30*a* by the means 30 for forming the stripe of the burn adjusting agent in a manner to conform with the clearance in the width direction between the adjacent stripes 20*b* of a plurality of stripes 20*b* of the burn adjusting agent formed on one surface of the web 20*b* or 20'*b* in a manner to extend in the transfer direction of the web 20*a* or 20'*a*.

It should be noted that the number of plural burn adjusting agent transfer regions 38, the width of each of the burn adjusting agent transfer regions 38, and the clearance between the adjacent burn adjusting agent transfer regions 38 correspond to the number of plural stripes 20*b* of the burn adjusting agent, the width of each of the stripes 20*b* and the clearance between the adjacent stripes 20*b*, respectively.

It is possible to set optionally the length of each of the plural burn adjusting agent transfer regions 38 in the circumferential direction within the range of the length in the circumferential direction of the outer circumferential surface of the roller 30*a*.

FIGS. 6A to 6D show various examples of a plurality of stripes of the burn adjusting agent formed by the various burn adjusting agent transfer regions 38 on the outer circumferential surface of the roller 30*a*, said stripes being formed on one surface of the long web 20*a* of the wrapping paper sheet transferred by the wrapping paper sheet transfer means 18. As described previously, the wrapping paper sheet forming the web 20*a* is wound by the winding device 23 shown in FIG. 3 so as to form a cigarette structure, followed by cutting the cigarette structure so as to prepare a plurality of cigarettes CG each having a prescribed length. Throughout these drawings, a reference letter "L" represents the length of a single cigarette CG thus prepared.

Figures 6A, 6B, 6C, 6D:
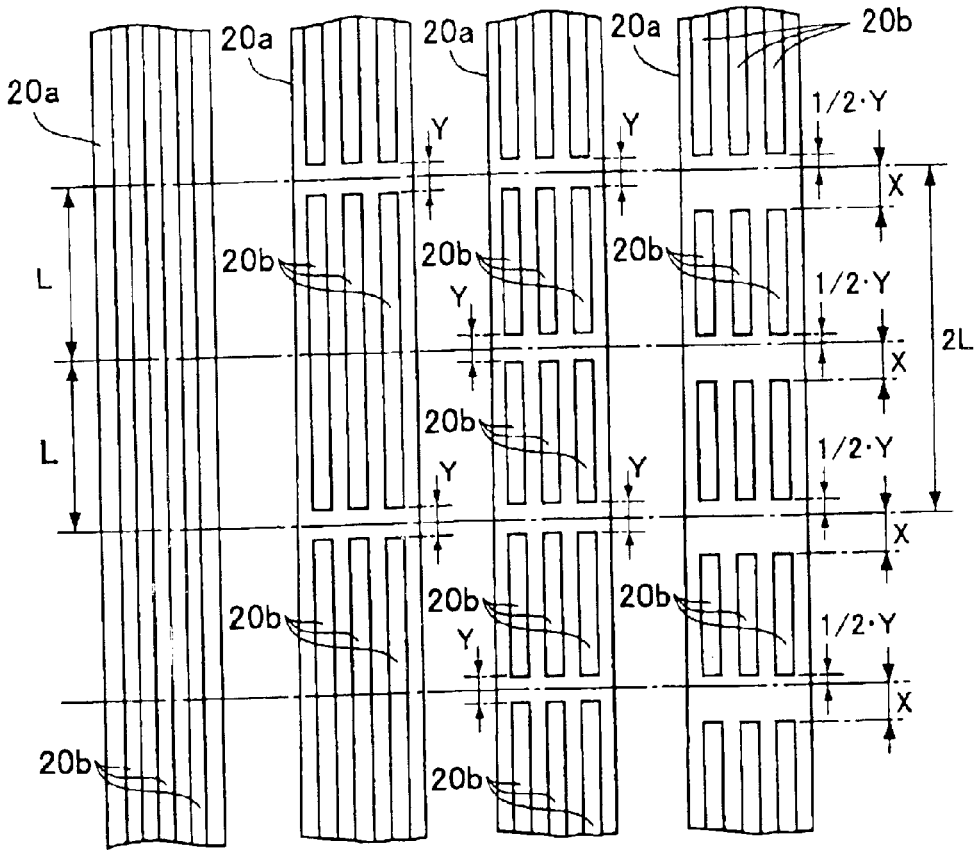
FIGS. 6A to 6D show various examples of a plurality of stripes of the burn adjusting agent formed on one surface of a long web of a wrapping paper sheet transferred by the wrapping paper sheet transfer means by various burn adjusting agent transfer regions formed on the outer circumferential surface of a roller, said stripes of the burn adjusting agent being formed by the means for forming the stripes of the burn adjusting agent shown in FIG. 4.

FIG. 6A shows a plurality of stripes 20*b* of the burn adjusting agent formed consecutively in the transfer direction of the web 20*a* from the starting end to the trailing end of the long web 20*a* of the wrapping paper sheet. The plural consecutive stripes 20*b* of the burn adjusting agent are formed by consecutively forming a plurality of burn adjusting agent transfer regions 38 in the circumferential direction on the outer circumferential surface of the roller 30*a*.

FIG. 6B shows a plurality of stripes 20*b* of the burn adjusting agent, which are formed a prescribed distance apart from each other in the transfer direction of the web 20*a*, i.e., the direction in which the wrapping paper sheet constituting the web 20*a* forms the longitudinal direction when the wrapping paper sheet is wound by the winding device 23 to form a cigarette structure, between the starting end and the trailing end of the long web 20*a* of the wrapping paper sheet. The prescribed distance noted above corresponds to the length 2L of two cigarettes CG.

The plural stripes 20*b* of the burn adjusting agent formed a prescribed distance apart from each other can be formed by partitioning each of a plurality of burn adjusting agent transfer regions 38 by said prescribed distance in the circumferential direction on the outer circumferential surface of the roller 30*a* having a circumferential length an integral number of times as much as the length 2L of the two cigarettes CG.

It is possible to set optionally the partitioning distance Y between the plural stripes 20*b* of the burn adjusting agent and the succeeding stripes 20*b* of the burn adjusting agent.

FIG. 6C shows a plurality of stripes 20*b* of the burn adjusting agent formed an additional prescribed distance, which is half the prescribed distance for FIG. 6B, apart from each other in the transfer direction of the web 20*a* between the starting end and the trailing end of the long web 20*a* of the wrapping paper sheet, i.e., the direction in which the wrapping paper sheet forming the web 20*b* provides the longitudinal direction when the wrapping paper sheet is wound by the winding device 23 shown in FIG. 3 to form a cigarette structure. The additional prescribed distance noted above corresponds to the length L of a single cigarette CG. Incidentally, it is possible to further partition said additional prescribed distance into optional sub-distances.

It is possible to set optionally the partitioning distance Y between a plurality of stripes 20*b* of the burn adjusting agent and the succeeding plural stripes 20*b* of the burn adjusting agent in the longitudinal direction in this case, too.

The plural stripes 20*a* of the burn adjusting agent formed the additional distance apart from each other can be prepared by partitioning each of the plural burn adjusting agent transfer regions 38 by said additional prescribed distance in the circumferential direction on the outer circumferential surface of the roller 30*a* having a circumferential length an integral number of times as much as the length L of the single cigarette CG.

Also, the plural stripes 20*b* of the burn adjusting agent formed by further partitioning said additional prescribed distance into optional sub-distances can be prepared by partitioning each of the plural burn adjusting agent transfer regions 38 by said additional prescribed distance, followed by further partitioning said additional prescribed distance into said optional sub-distances, in the circumferential direction of the outer circumference of the roller 30*a* having a circumferential length an integral number of times as much as the length L of the single cigarette noted above.

Further, FIG. 6D shows a plurality of stripes 20*b* of the burn adjusting agent formed apart from each other by the additional prescribed distance shown in FIG. 6C in the transfer direction of the web 20*a* between the starting end and the trailing end of the long web 20*a* of the wrapping paper sheet, i.e., the direction in which the wrapping paper sheet forming the web 20*b* provides the longitudinal direction when the wrapping paper sheet is wound by the winding device 23 shown in FIG. 3 to form a cigarette structure. It should be noted that, in the prescribed distance noted above, the wrapping paper sheet constituting the web 20*a* is not formed in only the edge side providing the igniting edge of the cigarette CB when the cigarette structure formed by the wrapping paper sheet wind-up means 26 shown in FIG. 3 is cut into a plurality of cigarettes CG each having a prescribed length by the cutting means 28 by a prescribed distance X in the direction in which the wrapping paper sheet wound to provide the cigarette structure provides the longitudinal direction.

As described previously, the prescribed distance X noted above can be set at an optional value within a range of between about 10 mm and about 25 mm.

Also, in the prescribed distance noted above, a region of ½·Y, in which the burn adjusting agent is not coated, is generated in the edge side opposite to the igniting edge of the cigarette CG when the wrapping paper sheet constituting the web 20*a* is wound by the winding device 23 shown in FIG. 3 so as to form a cigarette structure and, then, the cigarette structure thus formed is cut into a plurality of cigarettes each having a prescribed length by the cutting means 28.

In the web 20*a* shown in each of FIGS. 6B and 6C, the partitioning distance Y between the plural stripes 20*b* of the burn adjusting agent and the succeeding plural stripes 20*b* of the burn adjusting agent in the longitudinal direction generates the region of ½·Y, in which the burn adjusting agent is not coated, in one edge or both edges of the cigarette CG when the wrapping paper sheet constituting the web 20*a* is wound by the winding device 23 shown in FIG. 3 so as to form a cigarette structure and, then, the cigarette structure thus formed is cut into a plurality of cigarettes each having a prescribed length by the cutting means 28.

It should be noted that, if the cutting means 28 is brought into contact with the stripe 20*b* of the burn adjusting agent, the burn adjusting agent is attached to the cutting means 28. As a result, the sharpness of the cutting means 28 is impaired when the wrapping paper sheet wound to provide a cigarette structure is cut by the cutting means 28. However, the distance Y noted above permits eliminating the difficulty noted above.

Figure 6E:
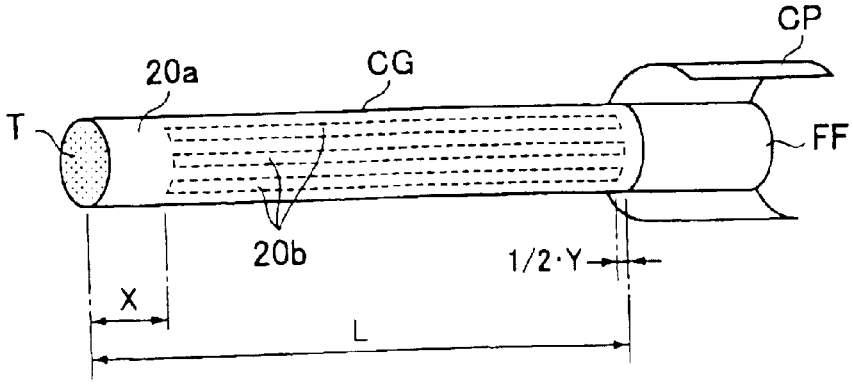
FIG. 6E is an oblique view showing the state that a filter is connected to a low fire-spreading cigarette manufactured from the long web of a wrapping paper sheet shown in FIG. 6D by the cigarette making machine shown in FIG. 3, with the filter tipping paper cut open.

FIG. 6E shows the state that the wrapping paper sheet constituting the web 20*a* shown in FIG. 6D is wound to wrap the tobacco filler material T by the winding device 23 shown in FIG. 3 so as to form a cigarette structure and, then, cut into a plurality of cigarettes CG each having a prescribed length by the cutting means 28, and that a tip paper CP accompanied by a filter FF is mounted to the region of ½·Y, in which the burn adjusting agent is not coated, on the edge side opposite to the igniting side of the cigarette CG.

The region of the prescribed distance X in which the stripe 20*b* of the burn adjusting agent is not formed and which is formed on the igniting edge side of the cigarette CG permits improving the ignition of the igniting edge and also permits improving the influence given by the stripe 20*b* of the burn adjusting agent to the taste of several initial puffs of the cigarette CG immediately after the ignition.

As described above, the wrapping paper sheet constituting the web 20*a* is wound by the winding device 23 shown in FIG. 3 so as to form a cigarette structure and, then, cut by the cutting means 28 so as to prepare a plurality of cigarettes CG each having a prescribed length. What should be noted is that a plurality of stripes 20*b* of the burn adjusting agent are formed in the region except the igniting edge side of the cigarette CG covering the region of the prescribed distance X in the direction in which the wrapping paper sheet forming the cigarette structure constitutes the longitudinal direction. The particular stripes 20*b* of the burn adjusting agent are formed by forming each of a plurality of burn adjusting agent transfer regions 38 on the outer circumferential surface of the roller 30*a* as follows. Specifically, each of the plural burn adjusting agent transfer regions 38 is partitioned by the additional prescribed distance, i.e., the distance L, in the circumferential direction of the outer circumferential surface of the roller 30*a* having a circumferential length an integral number of times as much as the length L of the single cigarette CG noted above. Further, when the wrapping paper sheet constituting the web 20*a* is wound to form a cigarette structure by the wrapping paper sheet winding means 26 shown in FIG. 3 at the additional prescribed distance and, then, cut by the cutting means 28 to prepare a plurality of cigarettes each having the additional prescribed length, the wrapping paper sheet is prolonged on only the igniting edge side of the cigarette CG by the prescribed distance X in the direction in which the wrapping paper sheet forming the cigarette structure provides the longitudinal direction.

According to the principle of the present invention, it is possible to further partition each of a plurality of stripes 20*b* of the burn adjusting agent that are formed intermittently as shown in FIG. 6D into optional sub-regions.

In the embodiment described above, the stripe pattern is the same in the individual cigarette regions on the web of the wrapping paper sheet, and the rod of the cigarette is cut every time a single cigarette region is moved forward. In other words, the coating of the stripe pattern is carried out in synchronism with the cutting.

Figure 7:
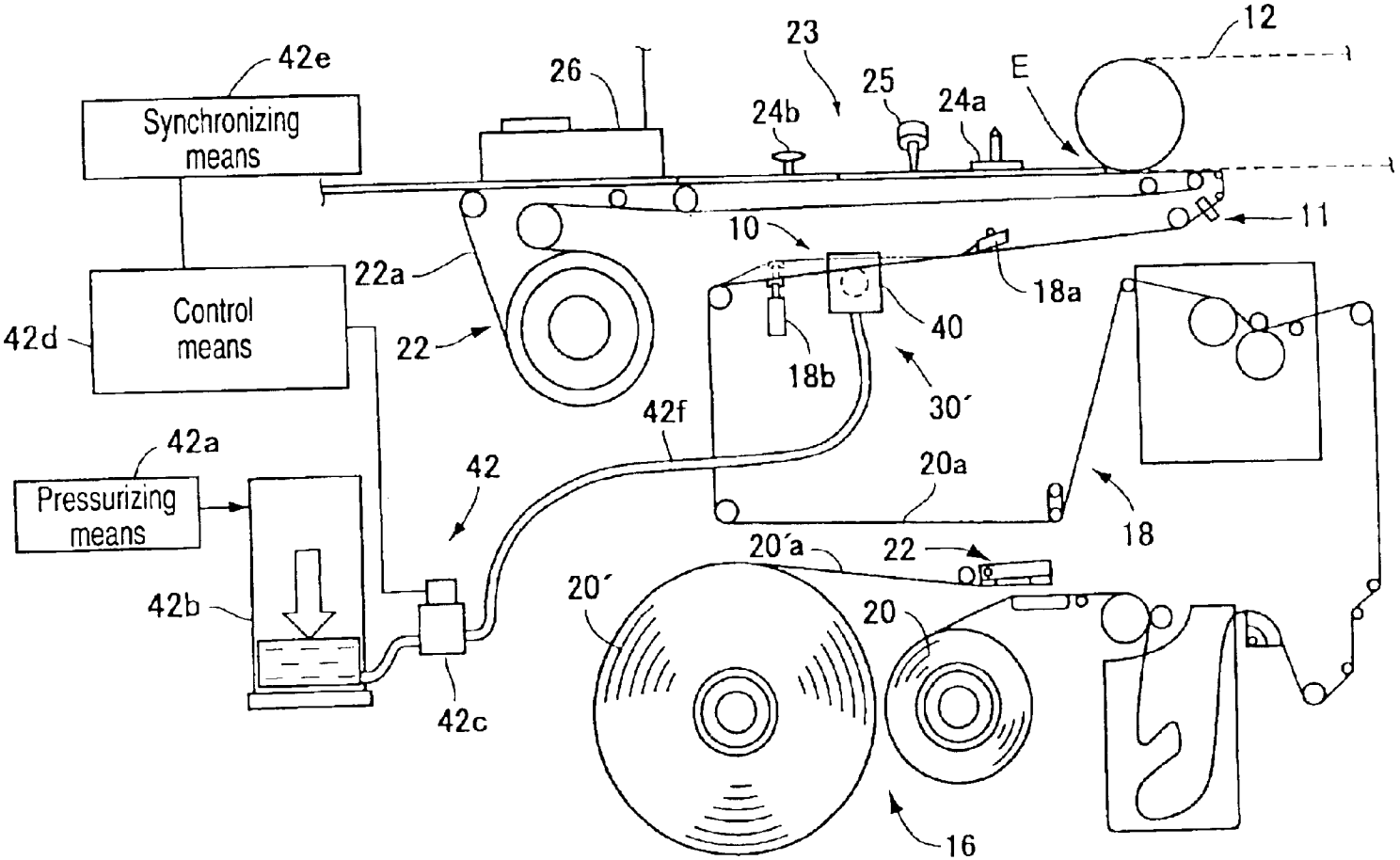
FIG. 7 shows in a magnified fashion a modification of the means for forming the stripe of the burn adjusting agent included in the apparatus, which is shown in FIG. 3, for manufacturing a low fire-spreading cigarette, together with the periphery of the modification of the means for forming the stripe of the burn adjusting agent.

The construction of the means 30' for forming the stripe of the burn adjusting agent according to a modification of the present invention will now be described with reference to FIG. 3 and FIG. 7 showing in a magnified fashion a modification of the means 30 for forming the stripe of the burn adjusting agent included in the machine for manufacturing a low fire-spreading cigarette, which is shown in FIG. 3, together with the periphery of the modification of the stripe forming means 30.

The modified means 30' for forming the stripe of the burn adjusting agent includes a nozzle member 40 that is in contact with or is positioned close to one surface of the long web 20*a* or 20'*a* of the wrapping paper sheet transferred by the main portion of the wrapping paper sheet transfer means 18 and a burn adjusting agent supply means 42 for supplying a burn adjusting agent to the nozzle member 40.

The burn adjusting agent supply means 42 includes a burn adjusting agent tank 42*b* equipped with a pressurizing means 42*a*, a control means 42*d* connected to a pump 42*c*, a synchronizing means 42*e* connected to the control means 42*d*, and a burn adjusting agent transfer tube 42*f* for transferring the burn adjusting agent from the pump 42*c* to the nozzle member 40.

Figure 8A:
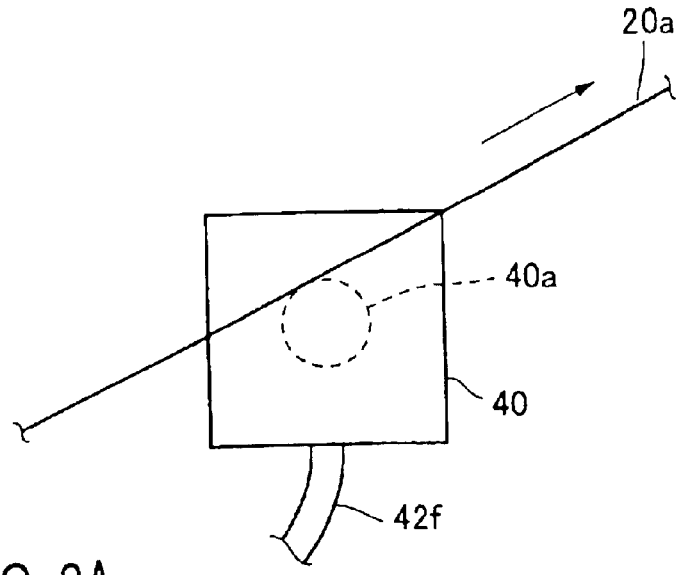
FIG. 8A is a side view showing in a magnified fashion the nozzle member included in the modification of the means for forming the stripe of the burn adjusting agent.
Figure 8B:
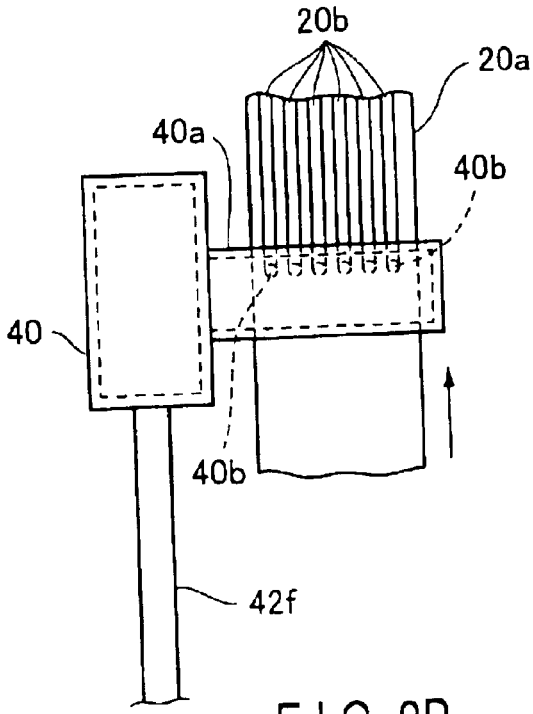
FIG. 8B is a front view of the nozzle member shown in FIG. 8A.
Figure 8C:
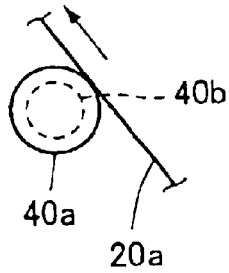
FIG. 8C is an edge view showing the edge surface of that portion of the nozzle member which faces the wrapping paper sheet as viewed in the direction exactly opposite to that for the side view shown in FIG. 8A.

The construction of the nozzle member 40 of the means 30' for forming the stripe of the burn adjusting agent will now be described in detail with reference to FIGS. 8A to 8C. FIG. 8A is a side view showing in a magnified fashion the nozzle member 40 shown in FIG. 7. FIG. 8B is a front view showing the nozzle member 40 shown in FIG. 8A. Further, FIG. 8C is a side edge view showing the edge surface of a portion 40*a*, which faces the wrapping paper sheet, of the nozzle member 40 as viewed in the direction exactly opposite to the side view shown in FIG. 8A.

The nozzle member 40 includes a cylindrical portion 40*a*, which faces the wrapping paper sheet, which is brought into contact with or is positioned close to one surface of the long web 20*a* or 20'*a* of the wrapping paper sheet transferred by the main portion of the wrapping paper sheet transfer means 18, and which extends in parallel to said one surface of the web 20*a* or 20'*a* in the width direction of the web 20*a* or 20'*a*. A plurality of nozzle holes 40*b* are formed on the outer circumferential surface of the portion 40*a*, which faces the wrapping paper sheet, in a manner to correspond to the clearance in the width direction of a plurality of stripes 20*b* of the burn adjusting agent formed by the means 30' for forming the stripes of the burn adjusting agent on one surface of the web 20*a* or 20'*a* in a manner to extend in the transfer direction of the web 20*a* or 20'*a*.

The number of plural nozzle holes 40*b*, the diameter of the nozzle hole 40*b* and the distance between the adjacent nozzle holes 40*b* correspond to the number of plural stripes 20*b* of the burn adjusting agent that are to be formed on one surface of the web 20*a* or 20'*a* by the means 30' for forming the stripes of the burn adjusting agent, the width of the stripe 20*b* and the distance between the adjacent stripes 20*b*.

The synchronizing means 42*e* included in the burn adjusting agent supply means 42 supplies a control signal required for allowing the control means 42*d* to control the operation of the pump 42*c* to the control means 42*d* in order to form a plurality of stripes 20*b* of the burn adjusting agent in a desired length in the transfer direction of the web 20*a* or 20'*a* in respect of the portion of the web 20*a* or 20'*a* of the wrapping paper sheet that is wound together with the tobacco filler material by the winding device 23 included in the cigarette making machine shown in FIG. 3 so as to form a cigarette structure and, then, cut into the individual cigarettes CB by the cutting means 28, with the length of each cigarette providing the basis, said each cigarette being manufactured by the cigarette making machine shown in FIG. 3 by using the long web 20*a* or 20'*a* of the wrapping paper sheet transferred by the main portion of the wrapping paper sheet transfer means 18.

It is possible for the synchronizing means 42*e* to use an encoder mounted on, for example, a guide or support roller included in the wrapping paper sheet transfer means 18.

It is possible for the control means 42*d* to control the operation of the pump 42*c* in synchronism with the distance of sending forth the web 20*a* or 20'*a* corresponding to the length of one cigarette CB in the wrapping paper sheet transfer means 18, said distance being detected by the synchronizing means 42*e*. As a result, it is possible for the nozzle member 40 to form a desired number of stripes 20*b* of the burn adjusting agent on one surface of the corresponding web 20*a* or 20'*a* from the plural nozzle holes 40*b*, as shown in, for example, FIG. 8B.

Figure 4:
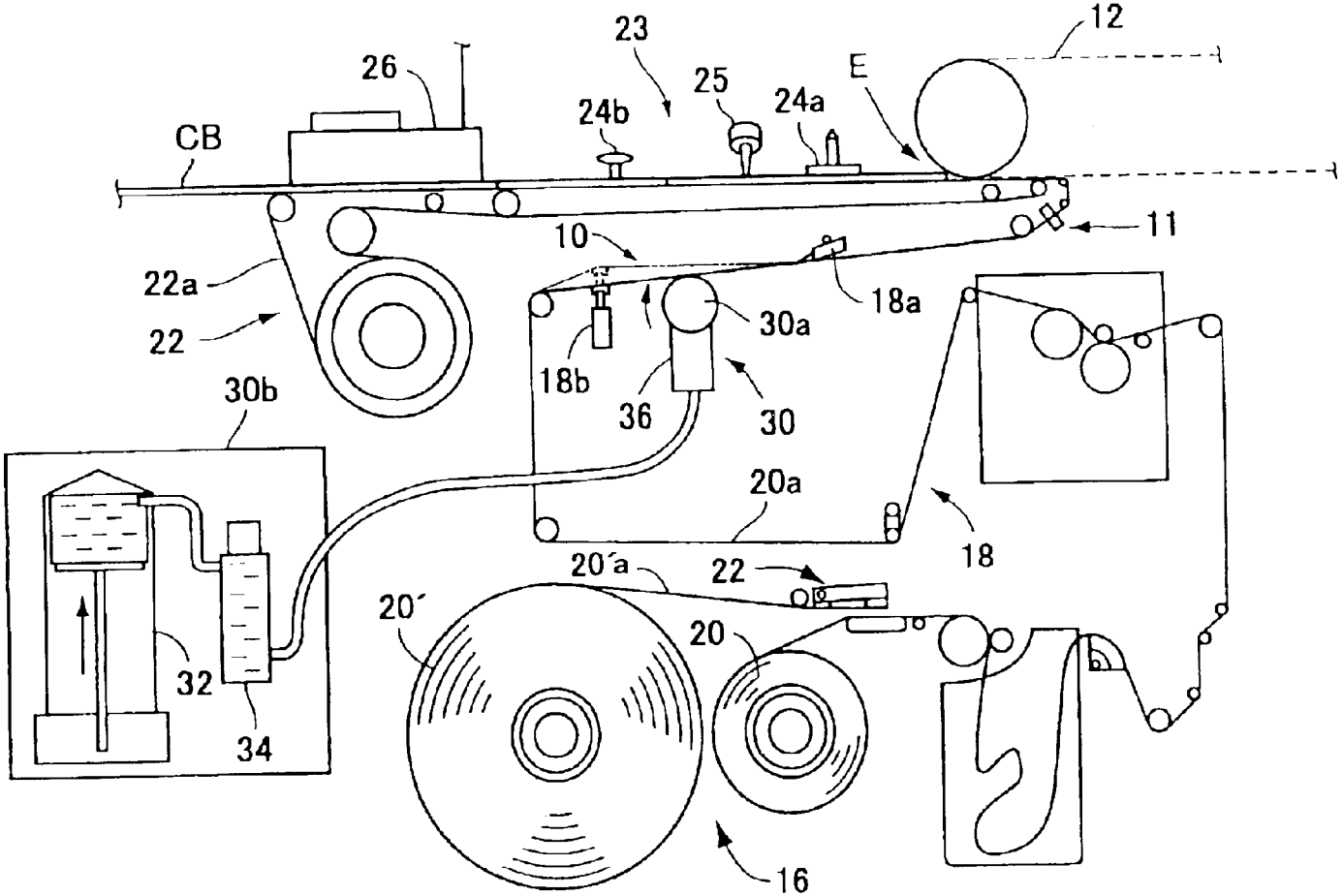
FIG. 4 shows in a magnified fashion the periphery of the means for forming a stripe of a burn adjusting agent included in the cigarette making machine shown in FIG. 3.

Naturally, it is possible to form a plurality of various kinds of stripes of the burn adjusting agent including those shown in FIGS. 6A to 6D relative to the long web 20*a* or 20'*a* of the wrapping paper sheet even in the case of using the modified means 30' for forming the stripes of the burn adjusting agent as in the case of using the means 30' for forming the stripes of the burn adjusting agent using the roller 30*a* referred to previously with reference to FIGS. 4, 5A and 5B.

As apparent from the description given above, the wrapping paper sheet is coated with the burn adjusting agent in synchronism with the cutting of the rod of the cigarette in the present invention, with the result that the coating pattern designed in advance of the burn adjusting agent in the individual cigarette is rendered exactly equal to the coating pattern of the burn adjusting agent in the individual cigarettes that are obtained by actually cutting the rod of the cigarette.

The inspecting apparatus 11 of the low fire-spreading cigarette wrapping paper sheet, which is a novel construction included in the cigarette making machine shown in FIG. 3, will now be described in detail with reference to FIGS. 3 and 9 to 11.

Figure 9:
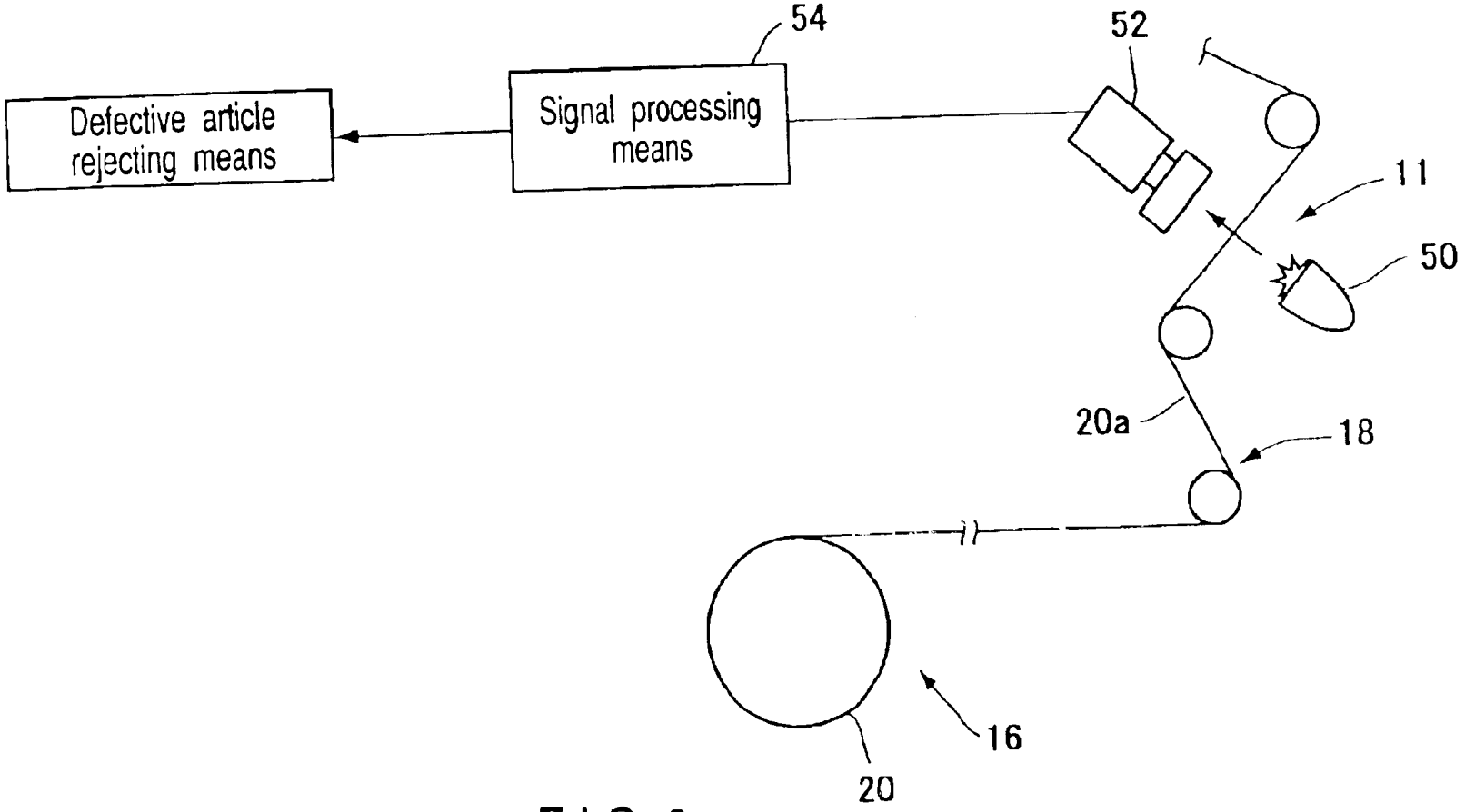
FIG. 9 schematically shows in a magnified fashion the inspecting apparatus of the low fire-spreading cigarette wrapping paper sheet, which is included in the low fire-spreading cigarette making machine shown in FIG. 3, together with the means for rejecting or discarding the defective article.
Figure 10A:
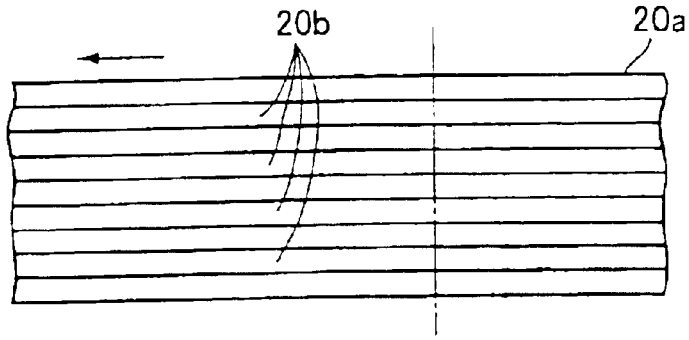
FIG. 10A is a plan view schematically showing how a plurality of stripes of the burn adjusting agent, which are formed from a long web of the wrapping paper sheet that is being transferred by the wrapping paper sheet transfer means shown in FIG. 3 by the apparatus shown in FIG. 3 for manufacturing the cigarette wrapping paper sheet, are inspected by the apparatus shown in FIG. 9 for inspecting the low fire-spreading cigarette wrapping paper sheet.
Figure 10B:
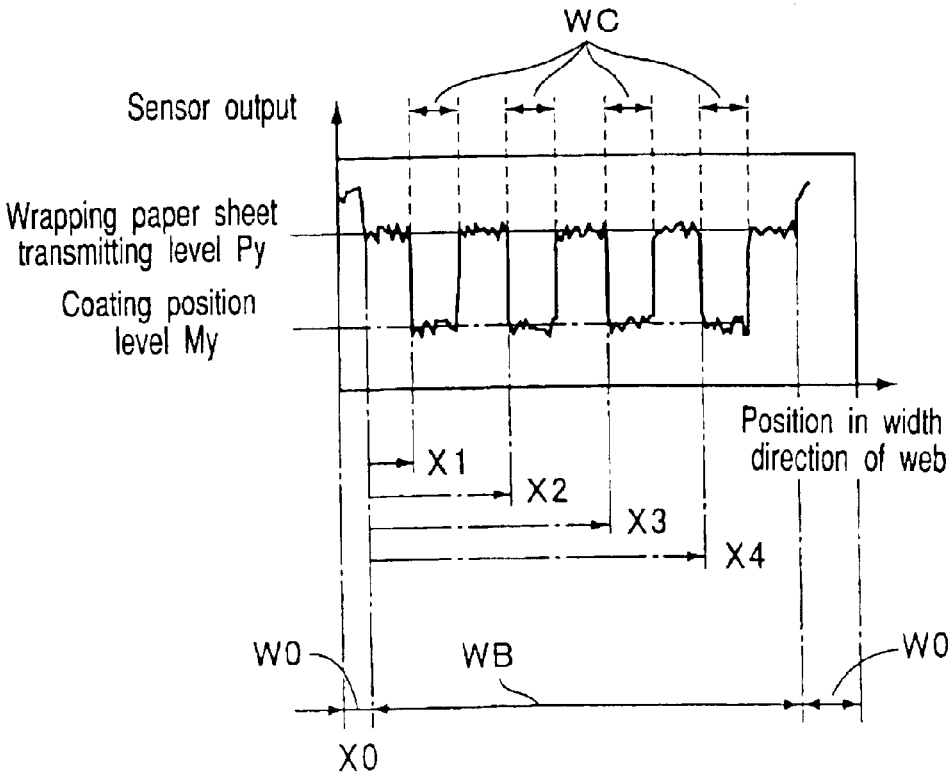
FIG. 10B shows the results of the inspection performed by the inspecting apparatus of the low fire-spreading cigarette wrapping paper sheet as shown in FIG. 10A.
Figure 11:
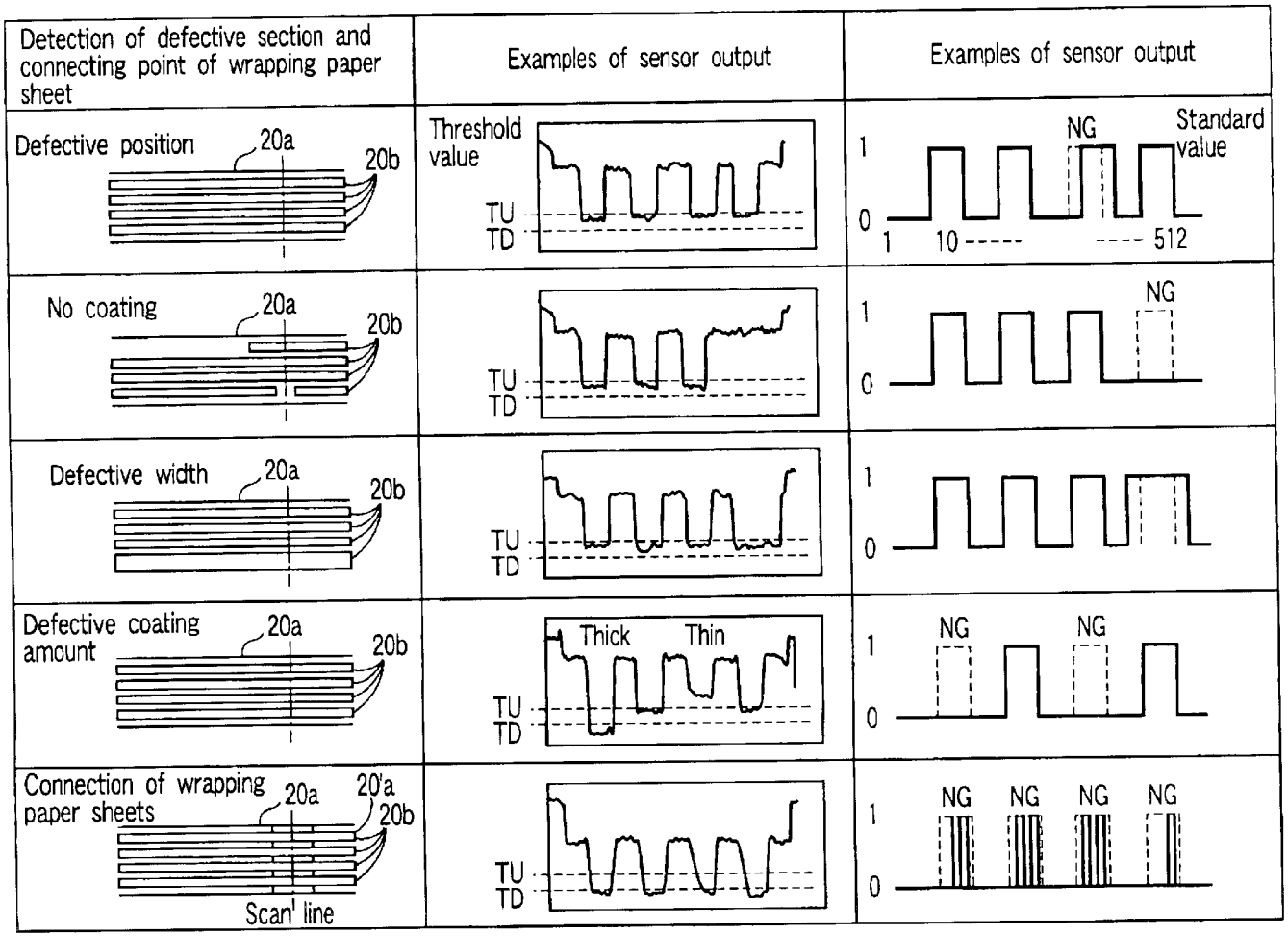
FIG. 11 shows the results of the various inspections that can be performed by the wrapping paper sheet inspecting apparatus shown in FIG. 9.

Incidentally, FIG. 9 is a side view schematically showing the construction of the inspecting apparatus 11 of the low fire-spreading cigarette wrapping paper sheet. FIG. 10A is a plan view schematically showing how a plurality of stripes 20*b* of the burn adjusting agent formed by the manufacturing apparatus 10 shown in FIG. 3 of a low fire-spreading cigarette wrapping paper sheet from the long web 20*a* or 20'*a* of the wrapping paper sheet transferred by the wrapping paper sheet transfer means 18 shown in FIG. 3 are inspected by the inspecting apparatus 11 shown in FIG. 9 of the low fire-spreading cigarette wrapping paper sheet. FIG. 10B shows the results of inspection performed by the inspecting apparatus shown in FIG. 9 of the low fire-spreading cigarette wrapping paper sheet. Further, FIG. 11 shows the results of various inspections which can be performed by the inspecting apparatus 11 shown in FIG. 9 of the low fire-spreading cigarette wrapping paper sheet.

As shown in FIG. 9, the inspecting apparatus 11 of the low fire-spreading cigarette wrapping paper sheet includes a light source 50 and a light intensity detecting means 52. The light source 50 is positioned to face one surface of the long web 20*a* or 20'*a* of the wrapping paper sheet transferred by the wrapping paper sheet transfer means 18 shown in FIG. 3 on which desired kinds of a plurality of stripes 20*b* of the burn adjusting agent are formed by the manufacturing apparatus 10 shown in FIG. 3 of the low fire-spreading cigarette wrapping paper sheet. On the other hand, the light intensity detecting means 52 is positioned on the side opposite to said one surface of the web 20*a* or 20'*a* so as to detect the intensity of the light projected from the light source 50 and transmitted through the web 20*a* or 20'*a*.

The light source 50 is a line illuminating means extending in a direction perpendicular to the transfer direction of the long web 20*a* or 20'*a* of the wrapping paper sheet transferred by the wrapping paper sheet transfer means 18. In other words, the line illuminating means forming the light source 50 extends in the width direction of the web 20*a* or 20'*a* as denoted by a dot-and-dash line shown in FIG. 10A so as to illuminate the one surface of the web 20*a* or 20'*a* with uniform illumination in the width direction of the web 20*a* or 20'*a*.

The light intensity detecting means 52 consists of a line sensor arranged on the side of the other surface of the web 20*a* or 20'*a* in symmetry with the light source 50 arranged on the side of one surface of the web 20*a* or 20'*a* and extending in a direction perpendicular to the transfer direction of the long web 20*a* or 20'*a* of the wrapping paper sheet, which is transferred by the wrapping paper sheet transfer means 18, i.e., extending in the width direction of the web 20*a* or 20'*a*, as denoted by the dot-and-dash line shown in FIG. 10A, so as to detect the intensity of the transmitting light by using a CCD (Charge Coupled Device).

Incidentally, it is possible for the line sensor constituting the light intensity detecting means 52 to be replaced by a plurality of spot sensors arranged on the other surface of the web 20*a* or 20'*a* in symmetry with the light source 50 arranged on one surface of the web 20*a* or 20'*a* and corresponding to only a plurality of stripes 20*b* of the burn adjusting agent on the web 20*a* or 20'*a* on the line extending in the width direction of the web 20*a* or 20'*a*.

A signal processing means 54 for processing the signal emitted from the light intensity detecting means 52 is connected to the light intensity detecting means 52, and a defective article rejecting or discarding means is connected to the signal processing means 54. Incidentally, the defective article discarding means is combined in general with a filter connecting apparatus for connecting a filter to the cigarette CG supplied from the cigarette making machine via a tip paper.

FIG. 10B shows the results of detection when the light intensity detecting means 52 detects a plurality of stripes 20*b* of the burn adjusting agent formed on the web 20*a* shown in FIG. 10A. The results of detection are shown in terms of the output of the line sensor constituting the light intensity detecting means 52 in the position in the width direction of the web.

As apparent from FIG. 10B, the light transmitting intensity is weaker in the outside WO of the web 20*a* in the position in the width direction of the web than within the range WB in which the web 20*a* is present. Also, the light transmitting intensity is further weakened within small ranges WC corresponding to a plurality of stripes 20*b* of the burn adjusting agent within the range WB in which the web 20*b* is present.

It is possible to know the concentration of the stripe 20*b* of the burn adjusting agent corresponding to the small range WC from the degree of output in the small range WC. It is also possible to know the width of the stripe 20*b* of the burn adjusting agent corresponding to the small range WC from the value of the width of the small range WC. It is also possible to know the number of stripes 20*b* of the burn adjusting agent formed in the web 20*a* from the number of small ranges WC in the range WB in which the web 20*a* is present. It is also possible to know the distribution of a plurality of stripes of the burn adjusting agent in the width direction of the web 20*a* from the distribution a plurality of small ranges WC within the range WB in which the web 20*a* is present. Further, it is possible to know the distance in the width direction between the adjacent stripes 20*b* of the burn adjusting agent formed in the web 20*a* from the value of the width between the adjacent small ranges WC within the range WB in which the web 20*a* is present.

FIG. 11 shows the results of inspection in which the output from the line sensor constituting the light intensity detecting means 52 is converted into a binary signal by the signal processing means 54 so as to judge the various defects and the connecting points of the wrapping paper sheet in respect of the coating of the burn adjusting agent.

In the examples of the defective positions, it is judged that a single stripe 20*b* of the burn adjusting agent among a prescribed number of stripes 20*b* of the burn adjusting agent, which are to be arranged in a prescribed concentration in a prescribed arrangement in the width direction of the web 20*a*, is deviated in the output from the line sensor constituting the light intensity detecting means 52 in the position in the width direction of the web.

In the examples in which the coating was not applied, it is judged that a single stripe 20*b* of the burn adjusting agent among a prescribed number of stripes 20*b* of the burn adjusting agent, which are to be arranged in a prescribed concentration in a prescribed arrangement in the width direction of the web 20*a*, was not formed (coated) in the output from the line sensor constituting the light intensity detecting means 52 in the position in the width direction of the web.

In the examples of the defective width, it is judged that the width of a single stripe 20*b* of the burn adjusting agent among a prescribed number of stripes 20*b* of the burn adjusting agent, which are to be arranged in a prescribed concentration in a prescribed arrangement in the width direction of the web 20*a*, failed to have a prescribed value in the output from the line sensor constituting the light intensity detecting means 52 in the position in the width direction of the web.

Further, in the defective coating amount, it is judged that the concentrations of two stripes 20*b* of the burn adjusting agent among a prescribed number of stripes of the burn adjusting agent, which are to be arranged in a prescribed concentration in a prescribed arrangement, failed to have prescribed values in the output from the line sensor constituting the light intensity detecting means 52 in the position in the width direction of the web. It should be noted that one of the two stripes 20*b* of the burn adjusting agent has a concentration exceeding the upper limit of the threshold value of a prescribed range of the concentration, i.e., a concentration exceeding the lower limit TD of the output range corresponding to the prescribed range of the concentration when it comes to the output from the line sensor noted above. Also, the other stripe 20*b* of the burn adjusting agent has a concentration failing to reach the lower limit of the threshold value of the prescribed range of the concentration, i.e., a concentration failing to reach the upper limit TU of the output range corresponding to the prescribed range of the concentration when it comes to the output from the line sensor noted above, and, thus, the concentration noted above is lower than the prescribed range of the concentration.

In the detection of the connecting points of the wrapping paper sheet, the connecting points of the wrapping paper sheets are judged by the situation that, in the connecting point where the starting edge of a long web 20' of a single wrapping paper sheet is connected by the automatic connecting means 22 to the trailing edge of a long web 20 of a single wrapping paper sheet in the wrapping paper sheet supply source 16 shown in FIG. 3, the paper transmitting output level in that portion of the web 20*a* in which the stripe 20*b* of the burn adjusting agent is not formed and the paper transmitting output level in all of the prescribed number of stripes 20*b* of the burn adjusting agent, which are to be arranged in a prescribed concentration in a prescribed arrangement in the width direction of the web 20*a*, are uniformly lowered in the output of the line sensor constituting the light intensity detecting means 52 in the position in the width direction of the web, compared with the case where the paper transmitting output level is detected normally in the points other than the connecting points noted above.

It is of no difficulty for those skilled in the art to understand that, when the signal processing means 54 has detected the various defects noted above on the prescribed number of stripes 20*b* of the burn adjusting agent, which are to be formed at a prescribed concentration and a prescribed arrangement on the long web 20 or 20' of the wrapping paper sheet or the connecting points of the long web 20 and 20' of the wrapping paper sheet on the basis of the output generated from the light intensity detecting means 52, the timing at which the cigarette CG wrapped with that portion of the long web 20 or 20' of the wrapping paper sheet which includes the defective portion or the connecting portion is cut by the cutting means 28 shown in FIG. 3 from the rod CB of the cigarette before the cutting can be excluded from the normal cigarette CG equipped with the filter by the defective article discarding means referred to above (not shown) by utilizing the construction equal to the synchronizing means 42*e* used in the modified means 30' for forming the stripe of the burn adjusting agent shown in FIG. 7.

Needless to say, the signal processing means 54 is capable of detecting the presence or absence of each of a plurality of stripes 20*b* of the burn adjusting agent in the direction in which the long web 20 or 20' of the wrapping paper sheet, which is wound to provide a cigarette structure, provides the longitudinal direction, i.e., in the transfer direction of the web 20 or 20' transferred by the wrapping paper sheet transfer means 18 in the embodiment shown in the drawings, while the web 20 or 20' is being transferred at a prescribed speed by the wrapping paper sheet transfer means 18 on the basis of the output from the light intensity detecting means 52.

Also, it is possible to detect the length of the region in which each of the plural stripes 20*b* of the burn adjusting agent is not present in the direction in which the longitudinal direction noted above is provided from the time during which the light intensity detecting means did not detect each of the plural stripes of the burn adjusting agent and the transfer speed of the web 20 or 20' transferred by the wrapping paper sheet transfer means 18. It is also possible to detect the prescribed distance noted above from the igniting edge of the individual cigarette prepared by cutting the long web 20 or 20' of the wrapping paper sheet, said prescribed distance covering the region in which the plural stripes 20*b* of the burn adjusting agent are not formed on the wrapping paper sheet.

Further, it is possible to detect the specific values of the prescribed distance noted above and to detect that the prescribed distance noted above is set to fall within a range of between about 10 mm and about 25 mm.

Figure 12:
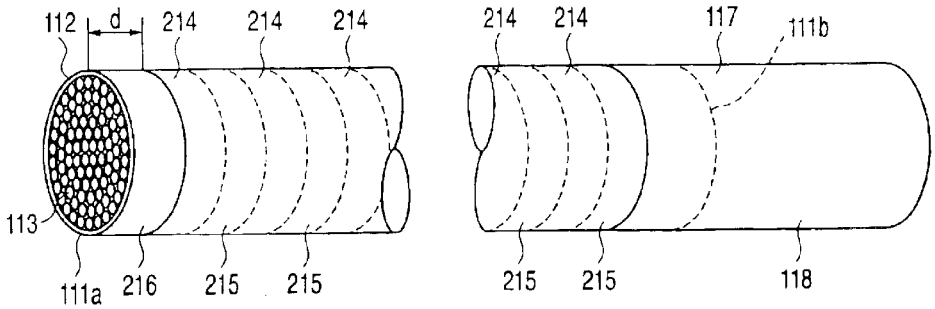
FIG. 12 is an oblique view, partly broken away, schematically showing an example of a cigarette according to another embodiment of the present invention.

The present invention is not limited to the specific embodiments described above. For example, it is possible for the burn adjusting agent to be coated in the form of a plurality of circles positioned apart from each other and extending in the circumferential direction of the tobacco rod. FIG. 12 shows a cigarette in which the burn adjusting agent is coated in the form of rings 214. The rings 214 define the burn control region and these annular burn control regions 214 are formed apart from each other. In the cigarette shown in FIG. 12, a burn adjusting agent is not coated in a region 216 extending from the igniting edge of the cigarette by a distance d. Also, an ordinary burn region 215 is defined between the adjacent annular burn control regions 214.

Figure 13:
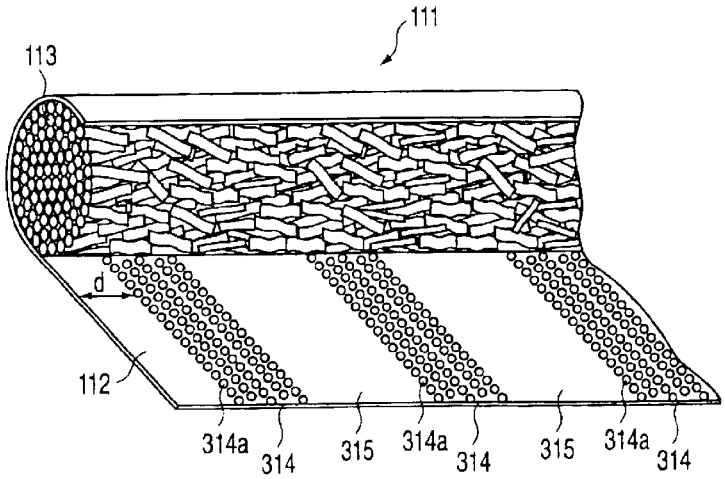
FIG. 13 is an oblique view, partly developed, showing a part of a cigarette according to still another embodiment of the present invention.

Further, in the embodiment shown in each of FIGS. 1, 2 and 12, the burn adjusting agent is coated on the entire striped region or annular region. However, it is also possible to coat the burn adjusting agent in the form of dots separated from each other. FIG. 13 shows a cigarette similar in construction to that shown in FIG. 12. In the cigarette shown in FIG. 13, however, the burn adjusting agent is coated in the annular region 314 in the form of many dots 314*a*. It should also be noted that an ordinary burn region 315 is defined between the adjacent annular regions 314 in which the burn adjusting agent is coated in the form of the many dots 314*a*. The dot-like coating of the burn adjusting agent can also be applied to the striped region 114 shown in each of FIGS. 1 and 2.

Some Examples of the present invention will now be described, though the present invention is not limited to these Examples.

EXAMPLE 1

First, coating materials containing various burn adjusting agents were prepared as follows.

(1) A commercially available potato starch powder was dissolved in water so as to prepare a solution containing about 25% by weight of the starch, followed by heating the solution so as to prepare a starch paste (coating material (A)).

(2) A commercially available carboxymethyl cellulose (CMC) powder was dissolved in water so as to prepare a solution containing 5.2% by weight of CMC, thereby obtaining a CMC paste (coating material (B)).

(3) A commercially available CMC powder and ammonium dihydrogen phosphate were dissolved in water so as to prepare a solution containing about 5.2% by weight of CMC and about 2.5% by weight of ammonium dihydrogen phosphate, thereby preparing a coating material (C).

(4) A commercially available sodium polyacrylate having a polymerization degree of 2700 to 7500 was used as a coating material (coating material D).

Tobacco wrapping paper sheets A, B and C were coated with each of the coating materials (A) to (C) given above. The tobacco wrapping paper sheet A had a basis weight of 22.6 g/m$^3$ and an inherent air permeability of 10 CORESTA units (CU). The tobacco wrapping paper sheet B had a basis weight of 25.6 g/m$^3$ and an inherent air permeability of 35 CU. The tobacco wrapping paper sheet C had a basis weight of 28.4 g/m$^3$ and an inherent air permeability of 80 CU. To be more specific, each of the coating materials (A) to (C) was spurted onto each of the tobacco wrapping paper sheets by using a syringe while running the tobacco wrapping paper sheets so as to coat the tobacco wrapping paper sheet with the coating material in the form of stripes, as shown in Table 1, followed by drying the coated tobacco wrapping paper sheets for 2 days at a temperature of 22° C. and a relative humidity of 60%. Then, a cigarette was made with the tobacco wrapping paper sheet coated with the burn adjusting agent such that the tobacco wrapping paper sheet was arranged to permit the striped burn control region to extend in the longitudinal direction of the cigarette. Three cigarettes were prepared for each of the tobacco wrapping paper sheets. Also prepared were cigarettes each wrapped with a tobacco wrapping paper sheet in which the burn control region was not formed (samples Nos. 0-1 to 0-3). Each cigarette had a circumferential length of 24.8 mm and a tobacco rod length of 59 mm. Also, the tobacco filler material contained 30% by weight of the expanded tobacco shreds, and the loading density of the tobacco filler material was 230 mg/cm$^3$.

The static burn rate (SBR) and the spread of a fire to the cloth (cotton duck No. 6) were measured for each of the cigarettes thus obtained by the method reported in NIST. However, the static burn rate was measured with the cigarette held horizontal. The results are shown also in Table 1.

EXAMPLE 2

In this Example, cigarettes were prepared by changing the width of the striped burn control region and the distance between the adjacent burn control regions.

Specifically, striped burn control regions were formed by the screen printing method on each of the wrapping paper sheets by using an aqueous solution containing 4% by weight of CMC, as shown in Table 2, followed by preparing six cigarettes for each sample as in Example 1 by using the wrapping paper sheet having the striped burn control regions formed thereon. The static burn rate and the spread of a fire to the cloth were measured for each of the cigarettes as in Example 1. The results are shown also in Table 2.

EXAMPLE 3

Six cigarettes were prepared for each sample as in Example 1 by changing the content of the expanded tobacco shreds in the tobacco filler material. In this Example, the tobacco wrapping paper sheet C was used as the tobacco wrapping paper sheet, and five stripes of the burn control regions were formed on the tobacco wrapping sheet by coating the tobacco wrapping paper sheet with CMC at a rate of 3.1 g/m$^2$. The width of the stripe of the burn control region was set at 2.5 mm, and the distance between the adjacent stripes of the burn control region was set at 2.5 mm. The static burn rate and the spread of a fire to the cloth (cotton duck No. 6) were measured for each of the cigarettes as in Example 1. The results are shown also in Table 3.

TABLE 1

| | | Tobacco wrapping paper sheet | | Stripe of burn control region | | | | Results of measurement | |
|---|---|---|---|---|---|---|---|---|---|
| Sample No. | Burn adjusting agent | Kind | Air Permeablity (CU) | Stripe width (mm) | Distance of stripes (mm) | Number of stripes | Coating amount (g/mm$^2$) | SBR (mm/min) | Spread of fire to cloth |
| 0-1 | None | A | 10 | — | — | — | — | 4.7 | Each of three cigarettes ignited cloth |
| 0-2 | | B | 35 | — | — | — | — | 5.6 | Each of three cigarettes ignited cloth |
| 0-3 | | C | 80 | — | — | — | — | 6.1 | Each of three cigarettes ignited cloth |
| 1 | Starch | A | 10 | 2.0 | 3.0 | 5 | 5.3–5.5 | 3.5–4.1 | Each of three cigarettes, when put on cloth, was extinguished |
| 2 | | B | 35 | 2.0 | 3.0 | 5 | 7.5 | 3.5–1.4 | Each of three cigarettes, when put on cloth, was extinguished |
| 3 | CMC | C | 80 | 2.5 | 2.5 | 5 | 3.1 | 4.5 | Each of three cigarettes, when put on cloth, was extinguished |
| 4 | CMC + Sodium dihydrogen phosphate | C | 80 | 2.0 | 3.0 | 5 | 0.9–3.8 | 2.7 | Each of three cigarettes, when put on cloth, was extinguished |
| 5 | Sodium polyacrylate | C | 80 | 2.5 | 2.5 | 5 | 19 | — | Each of three cigarettes, when put on cloth, was extinguished |

TABLE 2

| Sample No. | Tobacco wrapping paper sheet: Kind | Tobacco wrapping paper sheet: Air Permeablity (CU) | Stripe of burn control region: Stripe width (mm) | Stripe of burn control region: Distance of stripes (mm) | Stripe of burn control region: Number of stripes | Stripe of burn control region: Coating amount (g/mm$^2$) | Results of measurement: SBR (mm/min) | Results of measurement: Spread of fire fire to cloth |
|---|---|---|---|---|---|---|---|---|
| 6 | A | 10 | 1.0 | 4.0 | 5 | 0.74 | 4.3 | Four of six cigarettes, when put on cloth, were extinguished |
| 7 | | | 2.0 | 4.2 | 4 | 1.0 | 3.4 | Four of six cigarettes, when put on cloth, were extinguished |
| 8 | B | 35 | 2.0 | 3.0 | 5 | 1.2 | 4.2 | Three of six cigarettes, when put on cloth, were extinguished |
| 9 | | | 2.0 | 4.2 | 4 | 1.2 | 4.2 | Three of six cigarettes, when put on cloth, were extinguished |
| 10 | | | 3.0 | 3.2 | 4 | 1.2 | 3.8 | Each of six cigarettes, when put on cloth, was extinguished |
| 11 | | | 3.0 | 5.3 | 3 | 1.2 | 3.7 | Four of six cigarettes, when put on cloth, were extinguished |
| 12 | | | 4.0 | 4.3 | 3 | 1.2 | 3.9 | Three of six cigarettes, when put on cloth, were extinguished |
| 13 | C | 80 | 3.0 | 2.0 | 5 | 2.3 | 3.8 | Four of six cigarettes, when put on cloth, were extinguished |

TABLE 3

| Sample No. | Content of expanded tobacco shreds (% by weight) | Results of measurement: SBR (mm/min) | Results of measurement: Spread of fire to cloth |
|---|---|---|---|
| 14 | 0 | 4.3 | Cigarettes were not extinguished |
| 15 | 19.2 | 4.5 | Three of six cigarettes, when put on cloth, were extinguished |
| 16 | 33.9 | 4.7 | Four of six cigarettes, when put on cloth, were extinguished |
| 17 | 48.8 or more | 5.1 | Each of six cigarettes, when put on cloth, were extinguished |

What is claimed is:

1. A method of manufacturing a low fire-spreading smoking article, comprising:

a first step of transferring a tobacco wrapping paper sheet;

a second step of coating the wrapping paper sheet, which is being transferred, with a burn adjusting agent;

a third step of supplying a tobacco filler material containing at least 20% by weight of expanded tobacco material to the wrapping paper sheet coated with said burn adjusting agent;

a fourth step of wrapping the tobacco filler material supplied to said wrapping paper sheet with the wrapping paper sheet so as to prepare a rod body article; and a fifth step of cutting the rod body into a plurality of tobacco rods each having a prescribed length.

wherein said burn adjusting agent is coated in synchonism with the cutting of said rod body.

2. The method according to claim 1, wherein the burn adjusting agent is coated in the second step in the form a plurality of stripes extending in a longitudinal direction of the rod body.

3. The method according to claim 1, wherein said burn adjusting agent is coated in the second step in a direction perpendicular to the longitudinal direction of the rod body.

4. The method according to claim 1, wherein said burn adjusting agent is coated in the second step in the form of dots positioned apart from each other.

5. The method according to claim 1, wherein the burn adjusting agent is coated on the tobacco rod prepared by cutting the rod body except a tip region having a length of 10 mm to 25 mm from the tip of the tobacco rod.

6. The smoking article according to claim 1, further comprising the step of:

mounting a tip paper accompanied by a filter to a region of the smoking article in which the burn adjusting agent is not coated, on an edge side opposite to an igniting side of the smoking article.

* * * * *